United States Patent [19]

Birch

[11] 4,116,237

[45] Sep. 26, 1978

[54] EMERGENCY BREATHING APPARATUS

[76] Inventor: Norman Birch, 1709 Mantis Ave., San Pedro, Calif. 90732

[21] Appl. No.: 766,063

[22] Filed: Feb. 7, 1977

[51] Int. Cl.[2] ..... A62B 7/00

[52] U.S. Cl. ..... 128/142.7; 2/5; 2/205

[58] Field of Search ..... 128/142.7, 142.5, 142.6, 128/145 A, 145 R, 142 R, 142.2, 142.4, 141 A, 141, 203, 202; 2/5 R, 205

[56] References Cited

U.S. PATENT DOCUMENTS

| | | | |
|---|---|---|---|
| 645,408 | 3/1900 | Vajen | 128/142.7 |
| 2,488,261 | 11/1949 | Bedini | 128/145 A X |
| 2,850,011 | 9/1958 | Schaefer | 128/142 R |
| 3,180,333 | 4/1965 | Lewis | 128/141 A |
| 3,521,629 | 7/1970 | Reynolds | 128/142.7 |
| 3,895,625 | 7/1975 | DeLest | 128/142.7 X |
| 3,910,269 | 10/1975 | Ansite et al. | 128/142.7 X |
| 4,022,201 | 5/1977 | Diggs | 128/145 A |

*Primary Examiner*—Henry J. Recla

*Attorney, Agent, or Firm*—Robert J. Schaap; Robert M. Ashen

[57] ABSTRACT

An emergency breathing apparatus which comprises a tubular frame and which carries a hood capable of extending over the head of an individual using the apparatus. The frame contains a pair of frame sections constructed of tubular members having internal chambers containing oxygen under pressure. The frame sections are normally shifted to a closed position and when opened, a switch on the frame permits the passage of oxygen into a plenum area surrounded by the hood. Moreover, the hood is capable of being attached to the individual in such fashion that an essentially air-tight plenum chamber is created around the face portion of the user of the apparatus. The apparatus also serves as a crash helmet inasmuch as the crown of the hood is reinforced. Moreover, the hood is provided with a two-way communication system which is automatically energized upon donning of the apparatus.

39 Claims, 23 Drawing Figures

EMERGENCY BREATHING APPARATUS

BACKGROUND OF THE INVENTION

This invention relates in general to certain new and useful improvements in emergency breathing apparatus, and, more particularly, to emergency breathing apparatus which is a self-contained unit for use in environments containing breathing atmospheres deleterious to a human being.

It has been well established that death by fire is oftentimes caused by the loss of consciousness due to the inhalation of smoke and other forms of poisonous fumes which thereby prevents an individual from escaping the fire conditions. In anticipation of the hazard of fire, many habitations, such as tall buildings and factories, are equipped with fire extinguishers. The same holds true of passenger aircraft which are similarly provided with fire extinguishers, as well as other forms of fire-extinguishing devices. Tall buildings, as well as these aircraft, include overall systems of fire-extinguishing equipment such as water sprays, foams and the like.

These forms of fire-extinguishing systems provide the endangered individuals in the environment with some protection from the fire in the immediate surroundings. However, these systems are not at all effective for protecting the individual from smoke or poisonous gas emanating from the fire, even though the fire may be some distance away. Thus, if the individual were entrapped in an enclosed area, the individual might first succumb to unconsciousness, as a result of inhaling the smoke or poisonous fumes and thereby inhibiting or preventing the escape of the individual.

It has also been established that if an individual is located within an enclosed environment in which a fire is proximate or where toxic fumes are dispelled into the enclosed area in which the individual is located for about a fifteen minute period, the individual would probably not survive the adverse conditions. However, if such individual had at least a minimum breathing spell, as for example a fifteen minute breathing spell, the chances of survival are greatly improved.

There are at present a large number of commercially available emergency breathing apparatus used by firefighters, mine rescue teams, pilots parachuting from high altitude aircraft and the like. However, none of these extent emergency breathing apparatus are suitable for general public use, due to their complexity, or otherwise due to the fact that they are too cumbersome.

In order to provide the general public with a required emergency breathing apparatus, it is paramount that the apparatus must be easy to wear and also easy to operate. In addition, such an apparatus must contain at least about fifteen minutes of an oxygen supply, and when the oxygen supply is exhausted, the apparatus must also continue to function as a form of gas mask. In addition to the foregoing, the device must be constructed so that the eyes are protected from the smoke and the hair from burning. Notwithstanding, it has also been established that such a device must be suitable for all age groups of people, including full-grown adults to young children and newborn babies. In accordance with the above, it can be observed that these requirements dictate the necessity that the device be constructed in the form of a hood which can also be used as a form of bag in which to carry a baby.

OBJECTS OF THE INVENTION

It is, therefore, the primary object of the present invention to provide an emergency breathing apparatus which comprises a frame containing its own internal source of oxygen and a hood operable with the frame which is capable of easily being donned by an individual in an emergency situation.

It is another object of the present invention to provide an emergency breathing apparatus of the type stated which is designed for effective use in passenger aircraft.

It is a further object of the present invention to provide an emergency breathing apparatus of the type stated which can also be used as a flotation device in order to replace life jackets which are often used in various forms of aircraft and the like.

It is an additional object of the present invention to provide an emergency breathing apparatus of the type stated which also serves as a crash helmet or other form of riot protection device and in addition serves as a gas mask to avoid deleterious atmospheric conditions.

It is an additional object of the present invention to provide an emergency breathing apparatus of the type stated which is highly effective in its operation and which can be constructed at a relatively low unit cost.

It is another salient object of the present invention to provide a method of conveniently and efficiently providing an emergency breathing system to individuals in an enclosed environment which is subjected to poisonous fumes or otherwise an external atmospheric condition which is deleterious to the normal breathing of a human being.

It is yet another object of the present invention to provide an emergency breathing apparatus of the type stated which is completely self-contained and which is automatically operable to provide a source of oxygen and also to provide a communications system automatically upon donning of the device.

With the above and other objects in view, my invention resides in the novel features of form, construction, arrangement and combination of parts presently described and pointed out in the claims.

SUMMARY OF THE DISCLOSURE

The present invention relates to an emergency breathing apparatus which includes a main frame comprised of a pair of hingedly connected frame sections. Each of the frame sections are capable of being located in a closed position where they are located in juxtaposed relationship to each other, and spread apart on the hinge means at one end thereof to an open position. In addition, each of the frames is constructed of metal tubes so that the metal tubes include a source of oxygen under pressure which is sufficient to supply oxygen to a human being for approximately a fifteen minute period or greater.

A hood is operatively connected to the frame and is capable of being disposed over the head section of an individual. In addition, the hood is capable of being tied around the neck portion of the individual in order to provide an air-closed environment around the face of the individual, and in which way the individual will breathe the oxygen supplied from the tubes of the frame, which contain the reservoir of oxygen.

The apparatus of the present invention is provided with a communications system which prevents the isolation of the individual and enables the individual to speak to and hear another individual. Furthermore, this communications system is powered by a simple dry cell battery and the circuit thereof is only energized upon opening of the frame. Moreover, a valve mechanism in the frame permits the dispelling of oxygen from the tubular frame construction into an air plenum around the head of the user only upon the opening of the frame, so that in this way the apparatus is entirely automatically operated by merely donning the apparatus on the head of an individual.

In addition to the foregoing, the apparatus includes an oxygen flow regulator which is set to give a sufficient flow of oxygen for a full-grown man at an active exertion level. In addition, an economizing mechanism automatically adjusts the flow of oxygen due to the exertion level of the individual, and, in addition, this economizer system is designed to regulate the flow of oxygen with respect to the size of the individual.

In addition to the foregoing, the apparatus of the present invention is provided with a filter mechanism creating a one-way breathing system so that the apparatus can actually function as a form of gas mask when the oxygen level is depleted.

In a modified form of the invention, the apparatus may include a flotation bag which permits the apparatus to operate as a flotation mechanism, thereby enabling the replacement of conventional lifejackets. In another embodiment of the present invention, the apparatus may be provided with a snorkel tube so that the apparatus not only serves as an excellent flotation device, but permits the breathing of air from an external environment in the event that the individual using the apparatus is required to await relief in a water medium.

The apparatus of the present invention is highly unique in that it is suitable for use in passenger aircraft. Inasmuch as modern airlines employ aircraft that fly at rather high altitudes, these airlines must, by law, provide all passengers with emergency oxygen to accommodate for the loss of cabin pressure. Instead of using the presently constructed and built-in emergency oxygen systems with all of the attendant incurred maintenance problems, each seat on the aircraft could be conveniently provided with a stowage space for the apparatus. In this respect, the apparatus can be collapsed into a relatively small, compartmentalized unit. Moreover, by law, the airlines are required to carry flotation jackets for each passenger over intercontinental flights. In this case, the apparatus of the present invention also serves as a flotation device which could replace the lifejacket normally required as well, as indicated above. Thus, during an in-flight emergency procedure, each passenger would don the apparatus with the hood section disposed over his head and would thereby be furnished with oxygen while the aircraft descends to a safe altitude. Aircraft maintenance would also be essentially far simpler and far less costly with this form of system.

It has been well established that many airborne accidents occur on or near to an airport, and many of the passengers in such a crashed aircraft would survive the crash except for the post-crash fire. In the event of the survivable accident in an airborne aircraft which employed the apparatus of the present invention, the survivers could merely don their hoods and escape with no hazard from smoke or by warning before the actual crash, but they would be protected against abrasion and knocks, at least in their head portion by the crash helmet crown of the apparatus. In addition, it can be observed that all emergency vehicles, such as police cars, fire engines, ambulances and the like, could be easily and very conveniently equipped with the apparatus of the present invention.

BRIEF DESCRIPTION OF THE DRAWINGS

Figure 1:
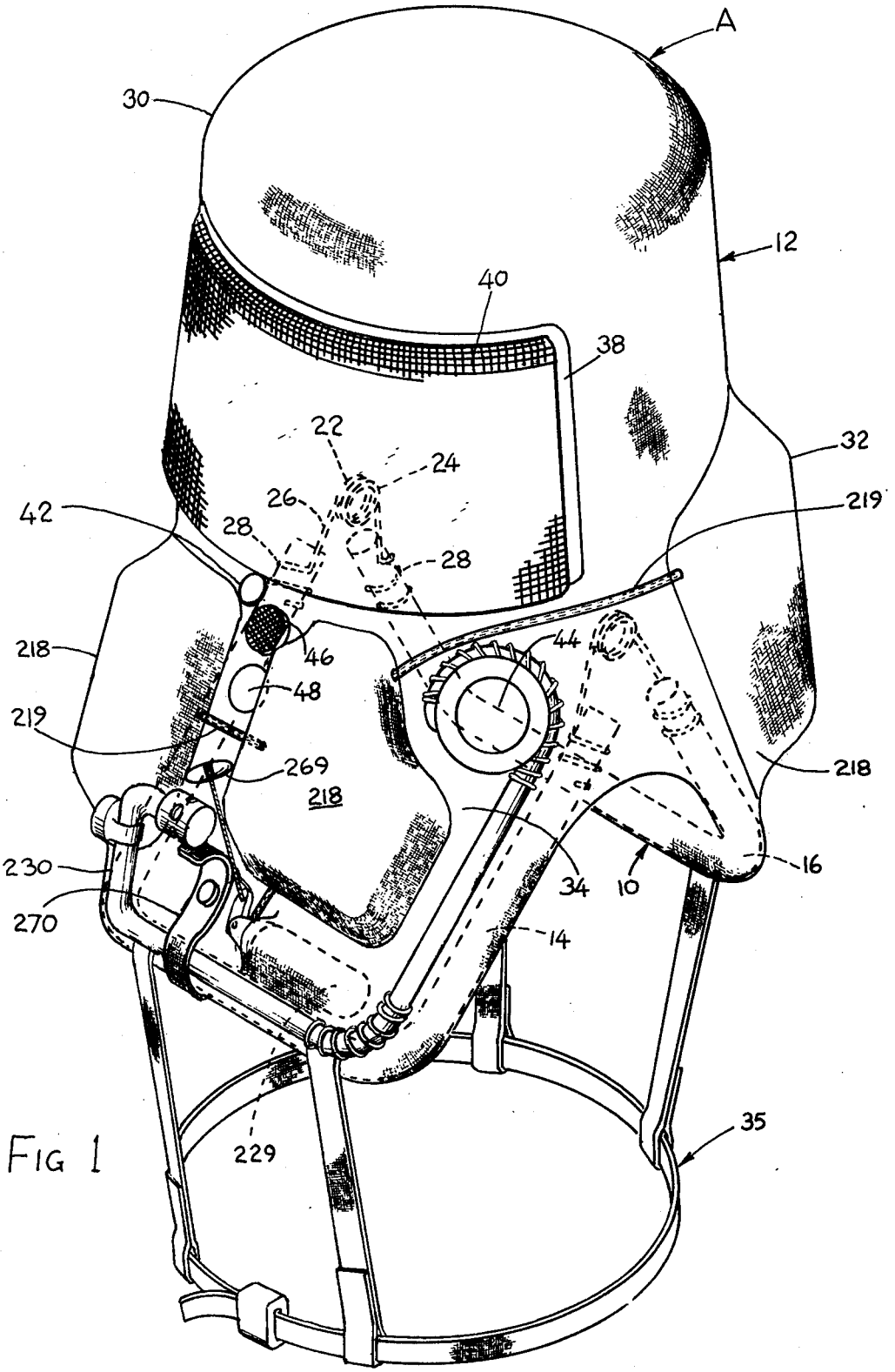
Figure 2:
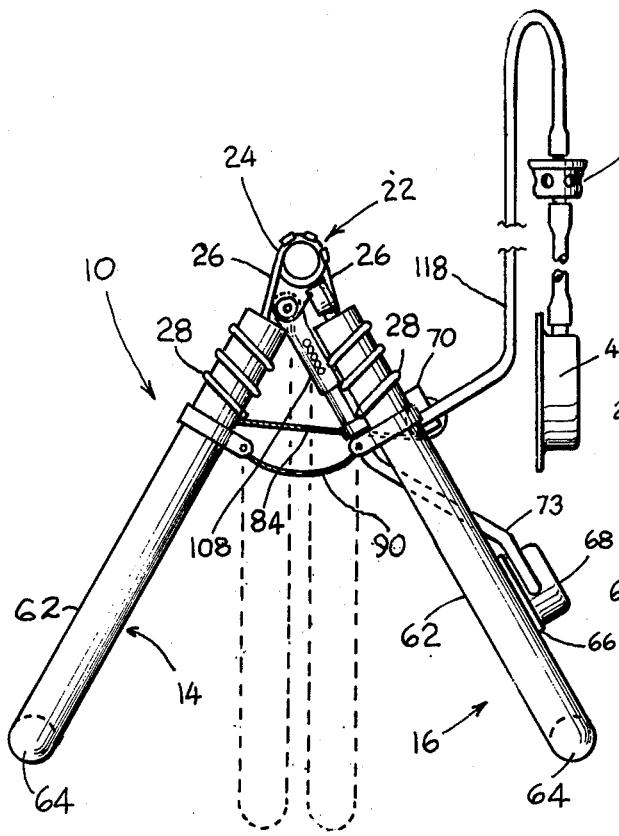
Figure 3:
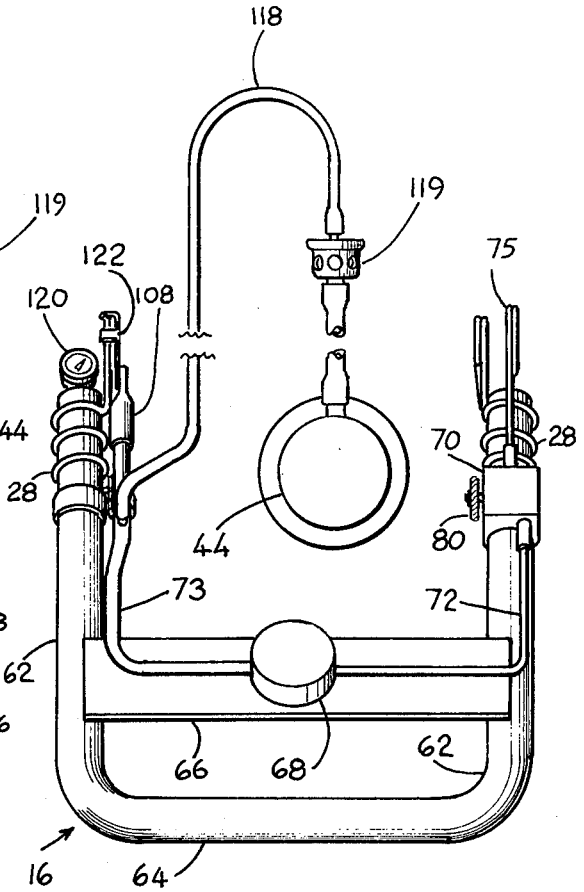
Figures 4, 5:
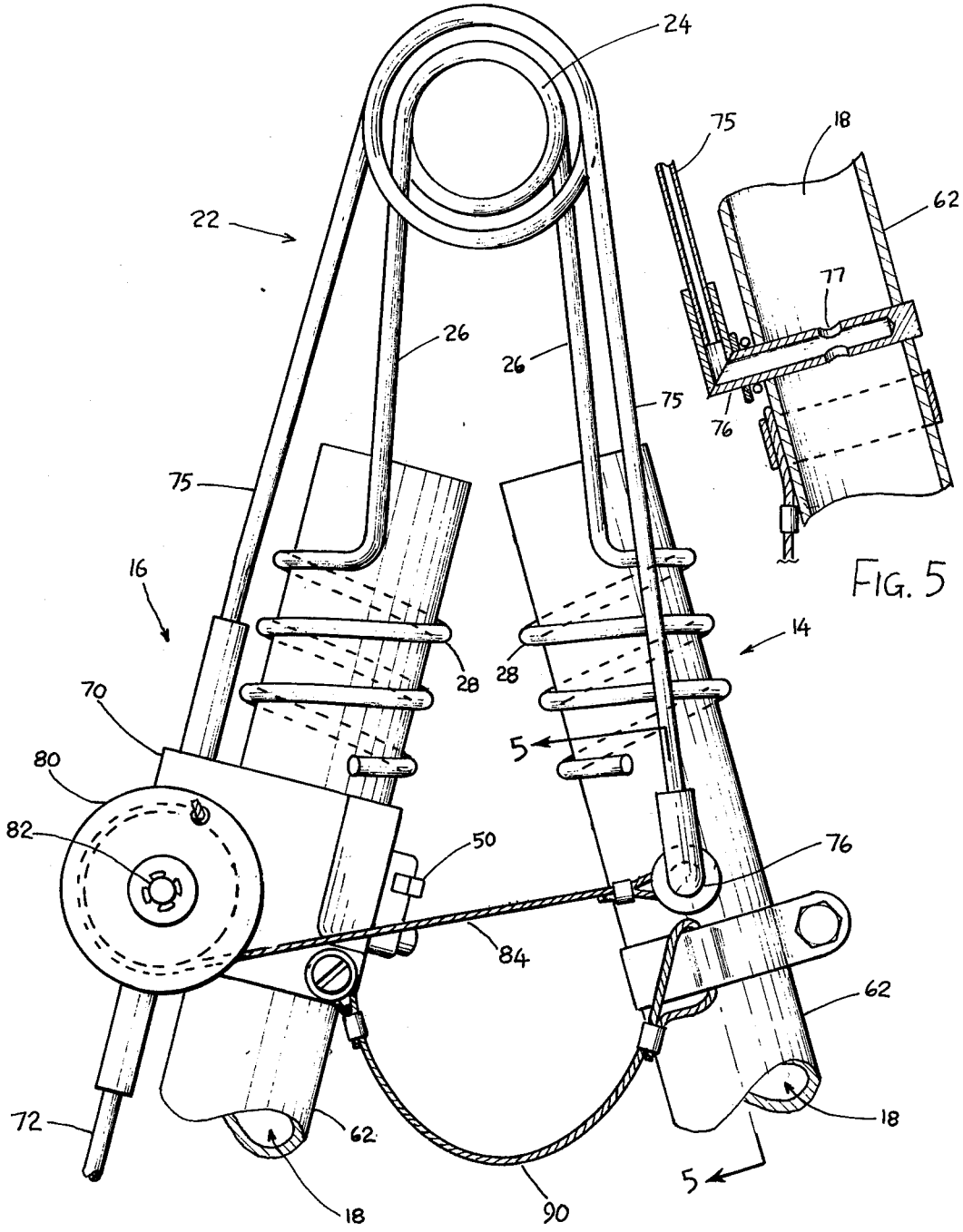
Figure 6:
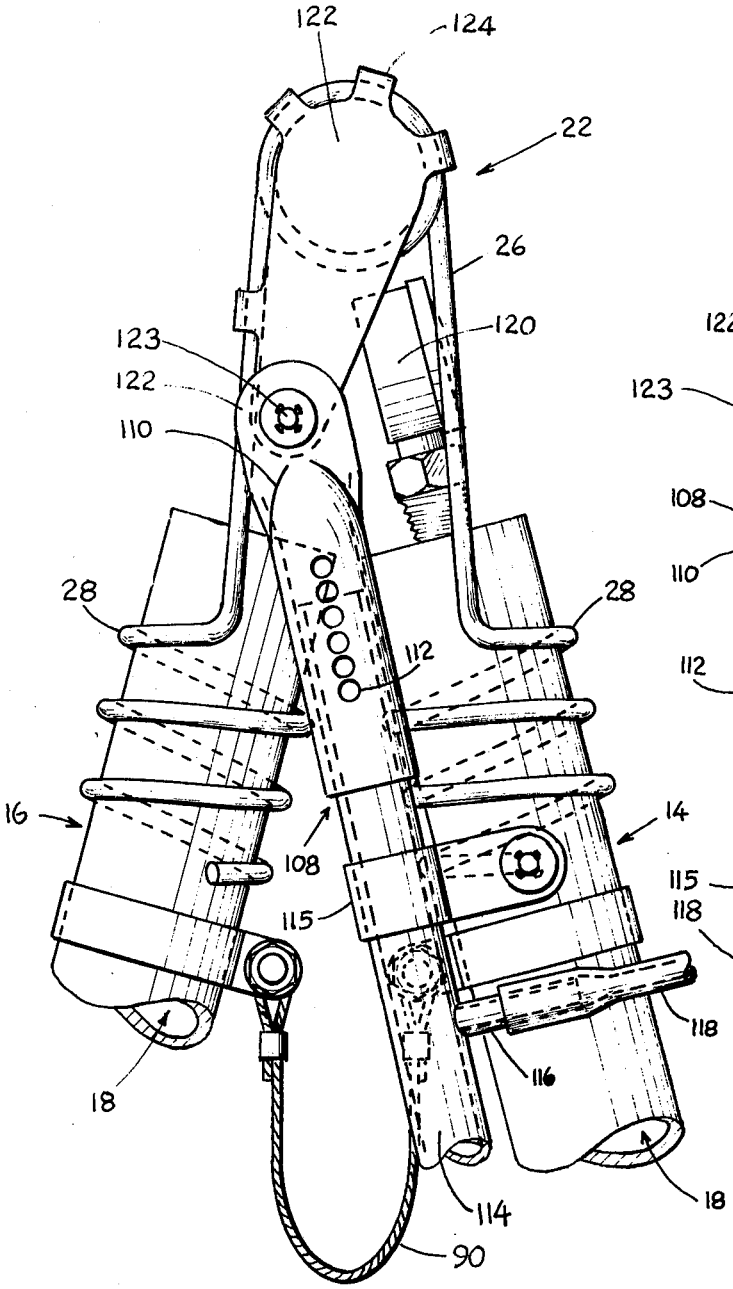
Figure 7:
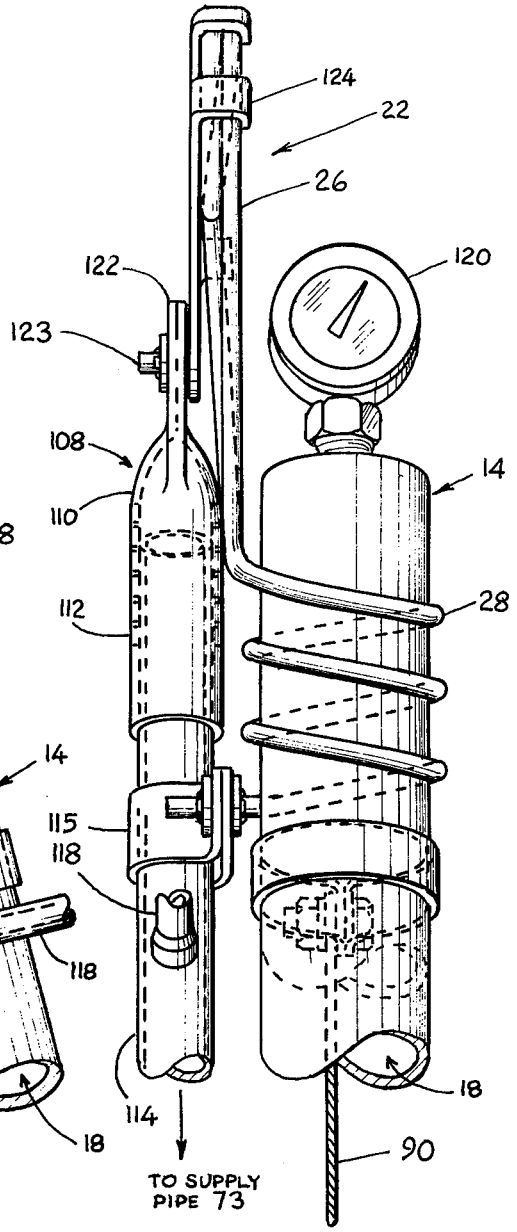
Figure 8:
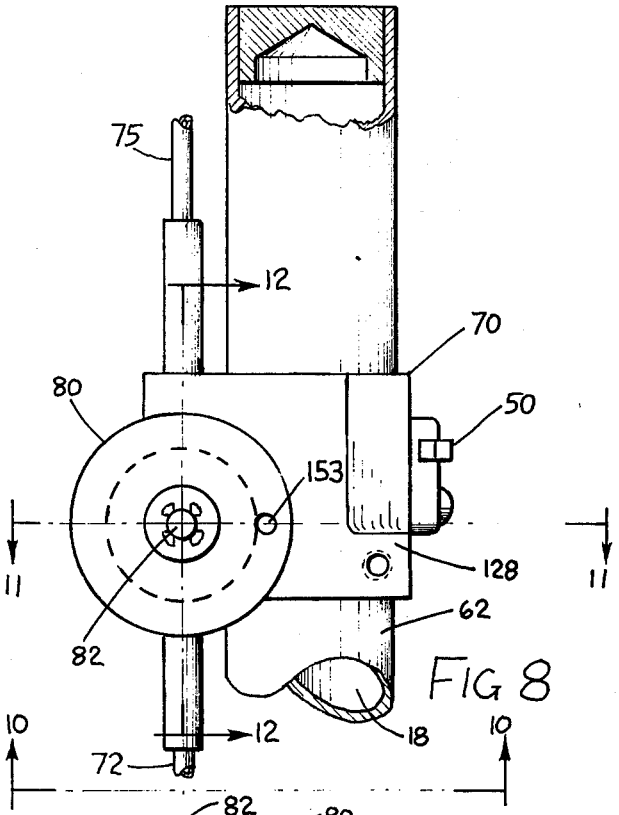
Figure 9:
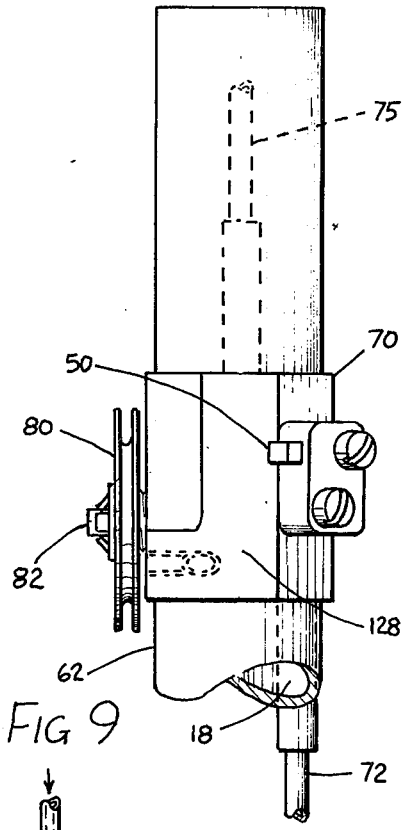
Figure 10:
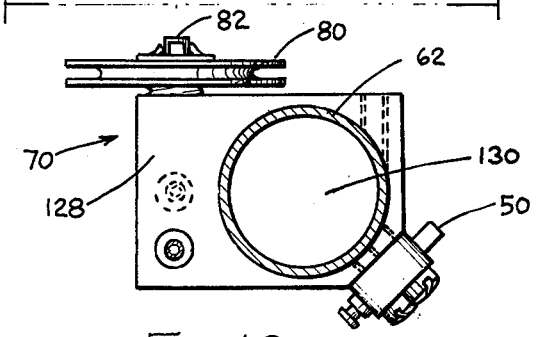
Figure 12:
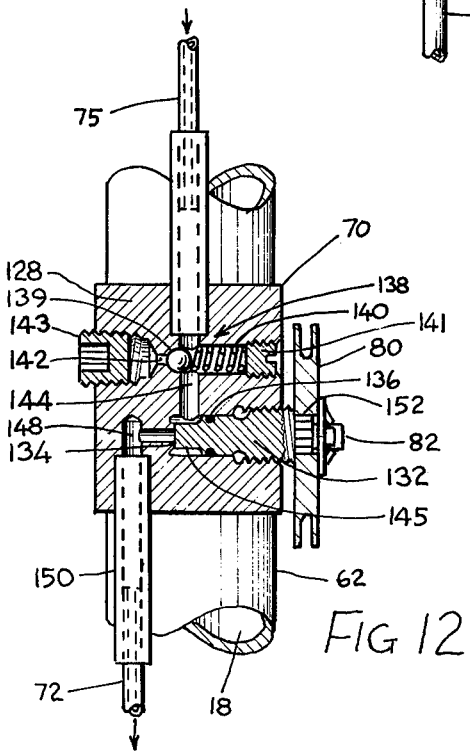
Figure 11:
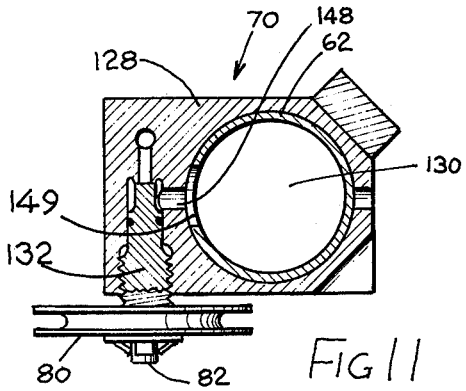
Figure 16:
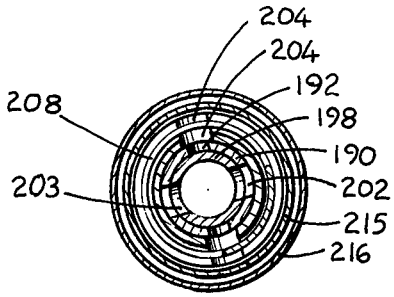
Figure 14:
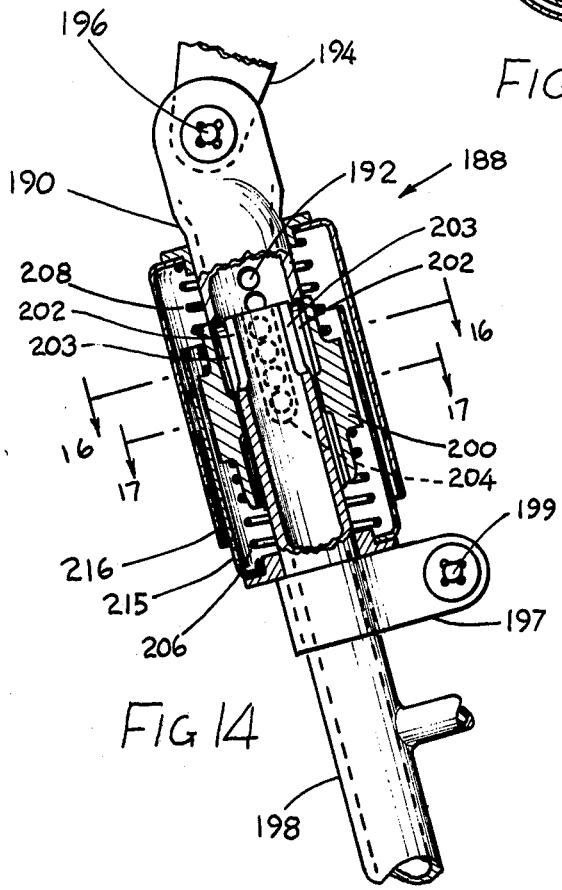
Figure 13:
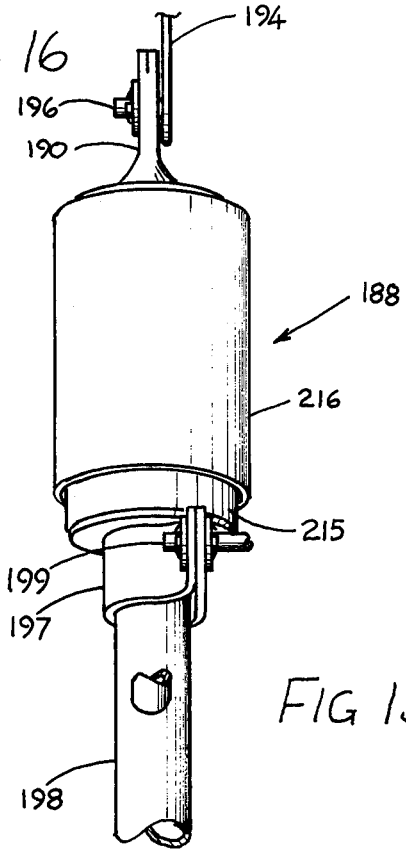
Figure 15:
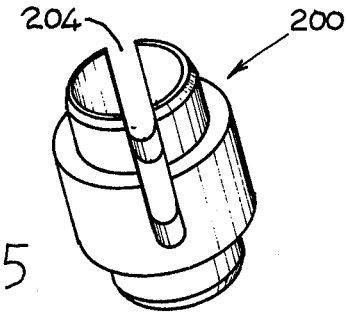
Figure 17:
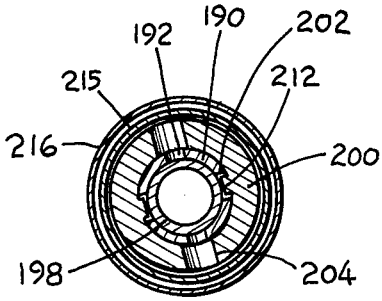
Figure 19:
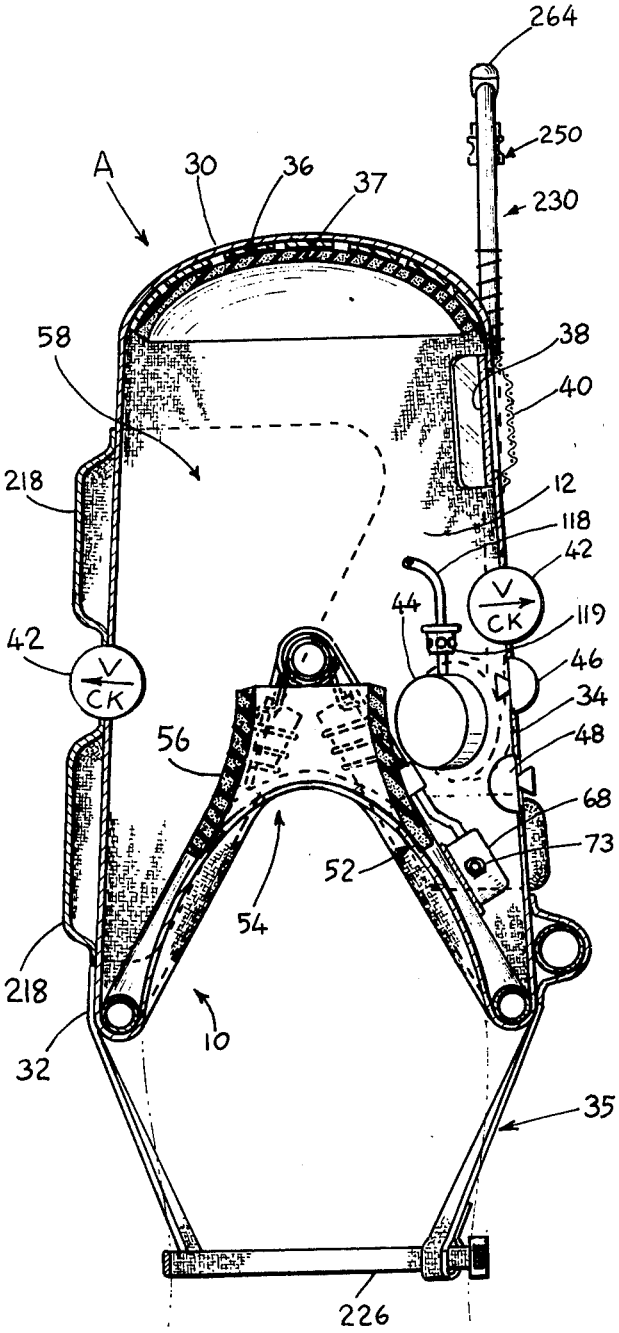
Figure 18:
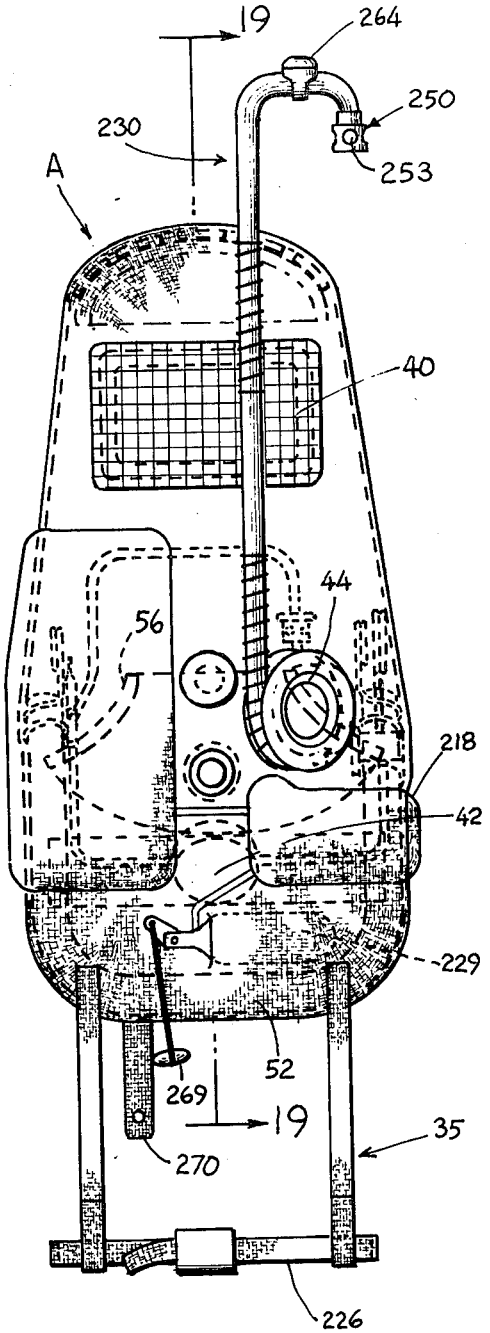
Figures 20, 21:
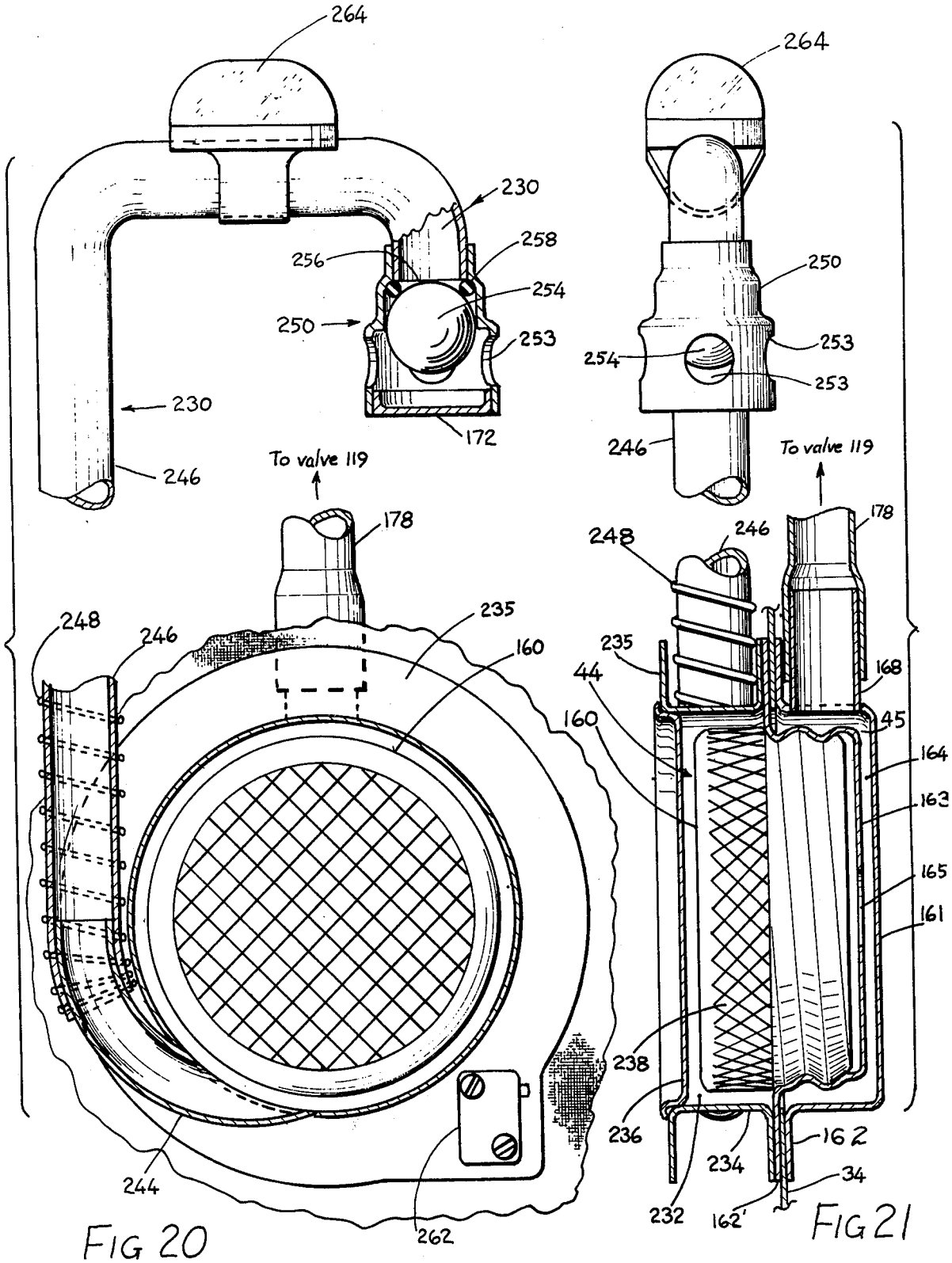
Figure 22:
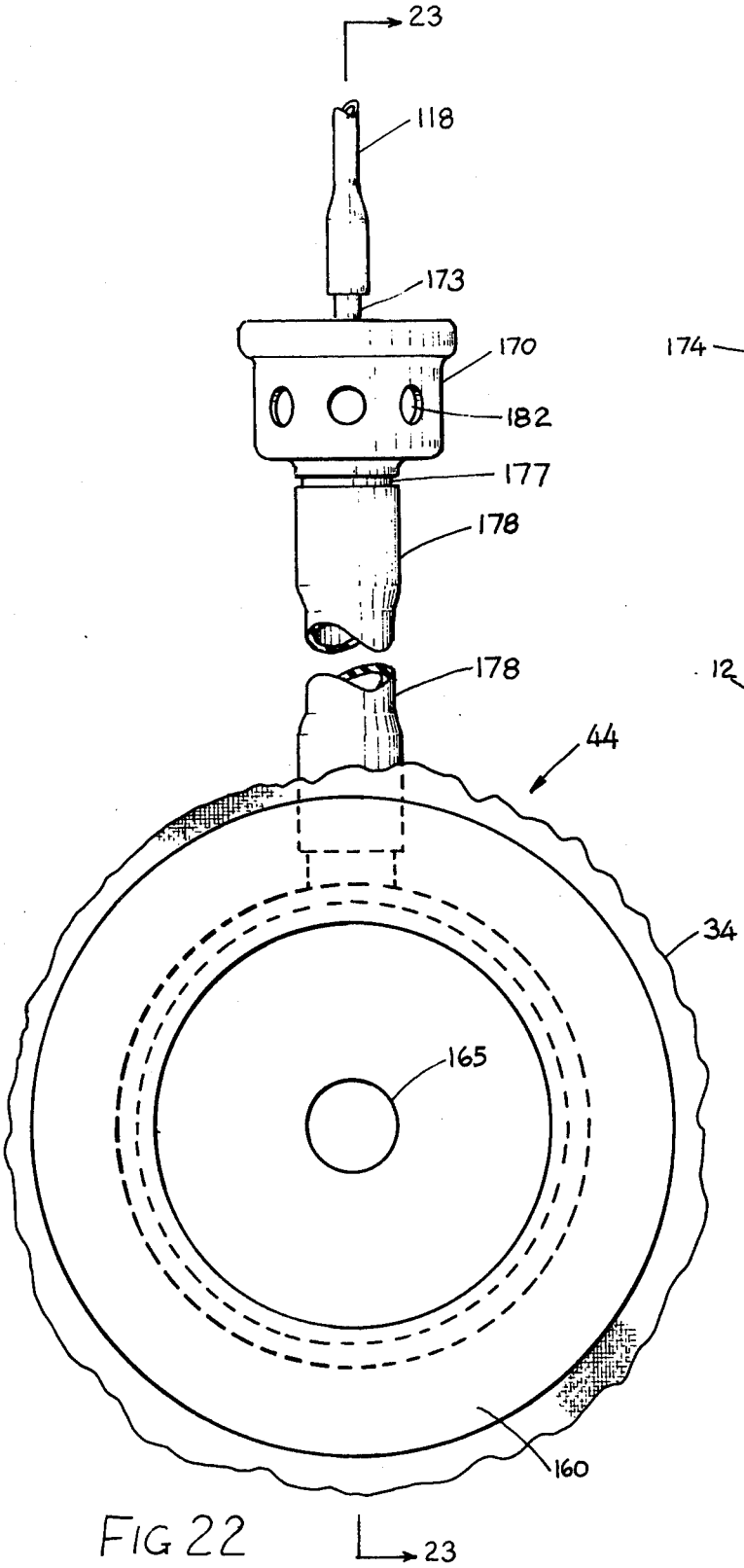
Figure 23:
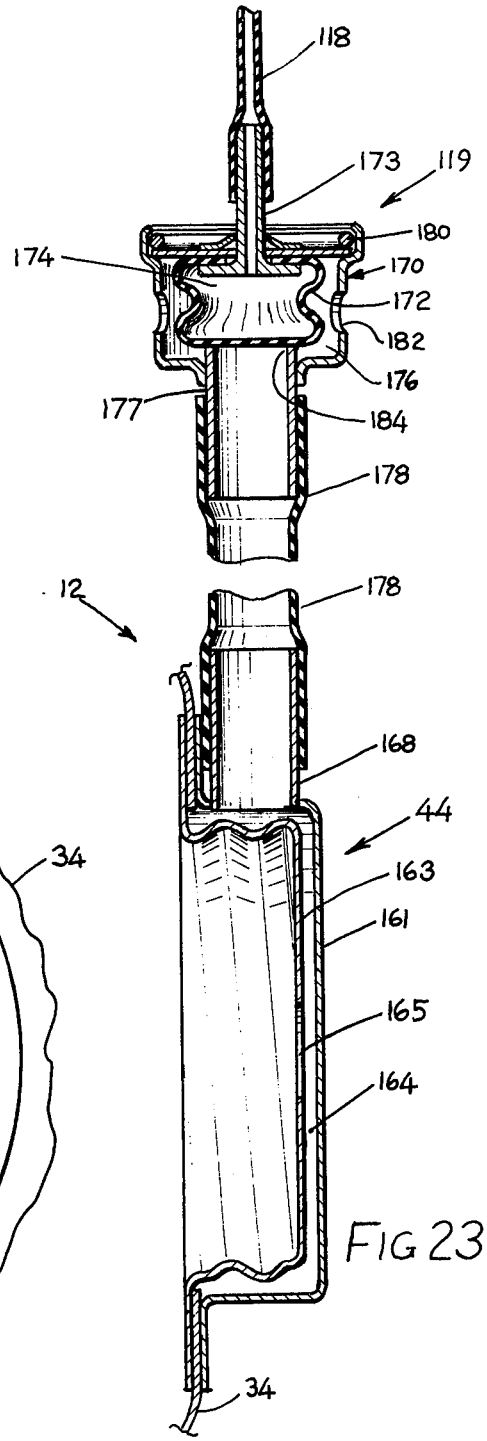

Having thus described the invention in general terms, reference will now be made to the accompanying drawings (8 sheets) in which:

FIG. 1 is a perspective view of an apparatus constructed in accordance with and embodying the present invention, partially shown in phantom lines;

FIG. 2 is a side elevantional view of the apparatus of FIG. 1, partially shown in phantom lines;

FIG. 3 is a front elevational view of the apparatus of FIG. 1, partially shown in phantom lines;

FIG. 4 is a side elevational view, partially broken away, and shown partially in phantom lines, of a portion of the frame and the hinge mechanism therefor forming part of the apparatus of the present invention;

FIG. 5 is a fragmentary sectional view shown taken along line 5—5 of FIG. 4;

FIG. 6 is a fragmentary side elevational view, partially in phantom lines, and showing in greater the manifold forming part of the present invention with an oxygen economizer thereon;

FIG. 7 is a fragmentary front elevational view of a portion of the frame section of FIG. 6 with the manifold and economizer thereon;

FIG. 8 is a fragmentary side elevational view, partially broken away and in section, and showing an oxygen shut-off valve forming part of the apparatus of the present invention;

FIG. 9 is a front elevational view of the oxygen shut-off valve mechanism illustrated in FIG. 8 of the drawings;

FIG. 10 is an end elevational view showing a portion of the oxygen shut-off valve and the conduit associated therewith, substantially taken along the plane illustrated by the line 10—10 of FIG. 8;

FIG. 11 is a fragmentary sectional view taken along line 11—11 of FIG. 8;

FIG. 12 is a fragmentary sectional view, showing the interior portion of the shut-off valve, taken along the line 12—12 of FIG. 8; and FIG. 13 is a front elevational view of a modified form of economizer used in the apparatus of FIG. 1;

FIG. 14 is a side elevational view, partially broken away and in section, and showing a portion of the oxygen economizer of FIG. 13;

FIG. 15 is a perspective view of a portion of the sleeve assembly used in the economizer of FIGS. 13 and 14;

FIG. 16 is a sectional view taken along line 16—16 of FIG. 14;

FIG. 17 is also a sectional view taken along line 17—17 of FIG. 14;

FIG. 18 is a side elevational view of the apparatus when used with airborne vehicles and like equipment to serve as a safety device for use in water media and showing the snorkel thereof in the raised position;

FIG. 19 is a vertical sectional view taken along line 19—19 of FIG. 18, somewhat similar to FIG. 18;

FIG. 20 is a front elevational view, partially broken away and partially shown in phantom lines and dotted lines, and showing a portion of the apparatus of FIG. 18;

FIG. 21 is a side elevational view, partially broken away and in section and showing a portion of the apparatus of FIG. 18;

FIG. 22 is a fragmentary front elevational view of an in-breathing valve which is illustrated in FIGS. 2 and 3 of the drawings; and FIG. 23 is a vertical fragmentary sectional view of the valve combination of FIG. 22.

DETAILED DESCRIPTION

Referring now in more detail and by reference characters to the drawings which illustrate preferred embodiments of the present invention, A designates an emergency breathing apparatus comprising a main frame 10 with a hood 12 disposed over and connected to the frame 10 in a manner to be hereinafter described.

The main frame 10 is more fully illustrated in FIGS. 2 and 3 of the drawings. The main frame 10 comprises a pair of essentially inverted, somewhat U-shaped frame sections 14 and 16, the frame section 14 of which is designed to be worn over and engageable with the breast portion of the individual and the frame section 16 designed to be worn over and engageable with the upper back of the individual when the apparatus A is donned.

Each of the frame sections 14 and 16 are formed of steel hollow tubes, thereby creating interior oxygen containing chambers 18, and these chambers 18 are integrally closed at the pair of opposed upper ends of the tubes, although closure could be accomplished by means of caps, or similar forms of fittings. In this respect, the main frame 10 internally contains its own oxygen chambers 18, thereby eliminating the necessity of the individual carrying a source of oxygen, as for example, a cylinder of oxygen attached in the form of a backpack. Moreover, the oxygen can be stored under pressure in the chambers 18 to an extent sufficient to enable at least a 15-minute or greater source of oxygen supply. In like manner, the oxygen could exist in the form of an oxygen containing gas, or other source which is capable of rendering oxygen.

The two frame sections 14 and 16 are hingedly connected together at their upper extremities by means of hinge springs 22. These hinge springs are designed to bias the two frame sections 14 and 16 to the closed position, as illustrated by the phantom lines in FIG. 2. Moreover, these two frame sections 14 and 16 can be pulled to the open position, where both such frame sections 14 and 16 are illustrated in solid lines in FIG. 2. In this same respect, the frame sections 14 and 16 could be cambered if desired, in the plane of the U-shaped portions of these two sections 14 and 16 in order to properly fit over the wearer's chest and upper back.

The hinge spring 22 is more fully illustrated in FIG. 4 of the drawings and generally comprises a coiled section 24 having downwardly and outwardly struck arms 26. The lower ends of the arms 26 are integrally provided with coiled attachment ends 28 which are tightly wound about and are thereby rigidly secured to the upper ends of each of the tubes forming part of each of the frame sections 14 and 16. Thus, it can be observed that the spring 22 serves both as a hinge and as a bias to press the frame sections 14 and 16 together.

The biasing action of the spring 22 serves to hold the hood 12, which is disposed upon the frame 10, together and flat for the purposes of stowage and, in addition, to hold the hood firmly to the wearer's body. In addition, it can be observed that the top portion of the frame section 14 and 16 do not contact each other when the lower portion is in the collapsed condition, as illustrated in the phantom lines of FIG. 2 of the drawings.

The hood 12 is more fully illustrated in FIG. 1 of the drawings, and the hood 12 is preferably formed of a fireproof fabric material of the type well-known in the art. Thus, the hood could be formed of a canvas material impregnated with a suitable fire retardant organophosphorous compound.

By further reference to FIG. 1, it can be observed that the hood 12 includes a head section 30 which extends downwardly as far as the shoulders of an individual and is integrally provided with a back section 32 and a front section 34 extending downwardly to approximately the lower ribs of the front and back of the individual. In this respect, the size of the hood 12 is based on the size of a well-built, approximately six-foot tall man. In this way, the hood is capable of being used on relatively large individuals and is also capable of being adjusted so that it can accommodate various sized individuals, in a manner as hereinafter described. The hood 12 is also provided with a harness 35 for securement about the torso of an individual.

At its upper end, the hood is provided with a relatively thick reinforcing and head protective liner which may be in the form of a discrete shield 36 (FIG. 19). This shield 36 may be formed of steel, or other form of strong metal, or plastics or reinforced plastics, and attached to the inner surface thereof in order to serve as a form of crash helmet. This shield 36 will be attached by any suitable means, such as adhesive or the like, or otherwise effectively sewn into the liner portion of the hood 12. This shield may be in the form of a multiplicity of discrete segments, as shown in FIG. 19, to facilitate stowage by permitting folding of the hood section 30. On the inner side of the shield 36 is a foam rubber cushion 37, as is normal in crash helmets, to distribute the forces imposed on the shield uniformly on the head of the wearer.

The head section 30 of the hood 12 is provided on its front face with an enlarged aperture having a flexible transparent plastic sheet 38 disposed over the aperture and serving as a window, as illustrated in FIGS. 18 and 19. The margins of the sheet 38 are secured to the material forming part of the hood 12 by means of seams, adhesives or the like. Due to the fact that most of these transparent plastics which serve as a window are flammable, a copper gauze flame arrestor 40 extends over the plastic sheet 38 and is also secured to the exterior surface of the head section 30. This gauze flame arrestor also serves as a heat dissipator.

Located beneath the transparent sheet 38 which serves as a window are two substantially identical outbreathing valves 42 (FIGS. 18 and 19) which are basically low-pressure one-way valves used on all forms of breathing apparatus. These valves 42 are essentially conventional in their construction, and are sewn or otherwise adhesively secured to the fabric forming the hood 12. The actual location of the breathe-out valves 42 is not critical, although two such valves 42 should be spaced on opposite sides of the hood 12 to preclude against the inlet of one of these valves being blocked by a fold in the fabric, particularly when the hood is used on a child or an infant.

A threaded recess 45 is provided in the front leg 34 and is essentially located at chest level to receive a screw-in type chemical gas filter 44. This chemical filter 44, which is illustrated in FIG. 21, is again an essentially conventional structure and is similar to those forms of filters used on gas masks for use in areas containing poisonous gases.

A communications system is provided by two speaker-microphone sets 46 and 48, as illustrated in FIGS. 1 and 19 of the drawings. It can be observed that one of these speaker-microphone sets faces inwardly with respect to the hood 12 and the other faces outwardly with respect to the hood 12. In this way, one of these sets serves to permit the user of the apparatus to speak and the other of the sets permits the user of the apparatus to hear another individual. In this respect, the inwardly facing speaker-microphone set 46 must be located near the mouth of the individual in order to operate as a microphone. The outwardly facing set 48 is not critical in its location with the exception that it should enable the user of the apparatus to hear external sounds introduced therein, and should therefore generally face in the same direction as the wearer of the apparatus.

A simple external switch (not shown) allowing two levels of amplification of the voice could also be incorporated if desired. In this respect, the speaker-microphone sets 46 and 48 may be powered by a small DC battery (not shown) which may be attached to the interior surface of the fabric forming part of the hood, preferably in the region of these two sets 46 and 48. This battery may preferably adopt the form of a so-called "pen-like battery". In addition, the speaker-microphone sets 46 and 48 would be operable upon the opening of the frame through a limit switch 50, as shown in FIG. 4, which would thereby energize the two sets 46 and 48 upon opening of the frame. Accordingly, power drainage from the battery is thereby avoided.

The fabric forming part of the head section 30 includes an inwardly extending section 52 forming a neck-receiving aperture 54, in the manner as illustrated in FIGS. 18 and 19 of the drawings. The internal tailoring of the fabric forming part of the hood 12 is designed to drape over the shoulders of the individual and enclose the neck in a continuous aperture 54 in order to form a gas-tight breathing plenum 58 around the head of the individual. An extensible, resilient band 56 (FIG. 19) is formed around the aperture 54 so as to engage the neck of the individual, and thereby form the air-tight plenum 58 around the head of the individual using the apparatus A. The band 56 is formed of a rubber-like material which is fairly elastic so that when the hood is pulled over the head of the individual, the rubber-like material is extensible enough to slip over the head and resilient enough to seal in a gas-tight manner around the neck of the individual.

In this case, the band 56 is sized so that it will actually form an air-tight seal even around a child's neck. Also located around the aperture 54 in relationship to the band 56 is a tie-string (not shown) which is normally in a slack condition sufficient that the band 56 will stretch over an adult's head without impediment. Moreover, when the apparatus A is used as a form of a bag to carry a baby, the hood is inverted with the baby resting on the crown 36 of the hood 12. In this case, the tie-string is pulled tight to close off the neck aperture in a gas-tight arrangement. Thus, the baby will be completely enclosed within the plenum, but which will nevertheless be provided with a source of oxygen for normal breathing.

Referring again to FIGS. 2 and 3, it can be observed that each of the frame sections 14 and 16 are comprised of a pair of vertically extending tubular arms 62 (often referred to herein as "tubes") which are connected by a bight portion 64. Extending across the two essentially vertically disposed arms 62 on the rear frame section 16 is a retaining plate 66 which carries a pressure regulator 68, or so-called "oxygen flow regulator" and which is essentially located in the region of the small of the back of the individual. The regulator 68 is essentially a conventional structure of the simple continuous flow type, which is preset to provide a sufficient flow of oxygen for a full-grown man at an active exertion level.

A control valve or so-called "oxygen cut-off valve" 70 (FIG. 4) is mounted on one of the frame sections 16 for permitting a flow of oxygen to the plenum chamber 58. The oxygen cut-off valve 70 is in fluid communication with and connected to the regulator 68 to cut-off the flow of oxygen from the chambers 18 to the regulator 68 by means of a tube 72. Extending from the oxygen flow regulator 68 is an oxygen supply pipe 73 which is connected to a discharge manifold 108, as hereinafter described in more detail. The valve 70 is supplied with oxygen from the internal chambers 18 through an oxygen delivery tube 75 which is in fluid communication with the internal chambers 18 containing the oxygen or other form of oxygen containing gas contained within the chambers 18. The tube 75 is provided with an extension 76 which extends into the chamber 18, as illustrated in FIG. 5, and which extension 76 is provided with an inlet aperture 77.

The bias created by the spring 22, as mentioned above, serves to hold the two frame sections 14 and 16 together for purposes of stowage. Nevertheless, the frame sections 14 and 16 can be spread to the open condition where they are essentially 30° apart with respect to the upper ends thereof. However, it is to be noted that the cut-off valve 70 is closed when the two frame sections 14 and 16 are in the closed position, so that oxygen does not escape from the tubes forming part of the frame sections 14 and 16. When the two frame sections 14 and 16 are spread apart, the cut-off valve 70 will open, thereby permitting oxygen contained within the chambers 18 of the frame sections 14 and 16 to pass into the valve 70 and into the regulator 68 and into the manifold 108 and thence into the plenum 58.

In accordance with the above, it can be observed that the oxygen cut-off valve 70 is closed when the apparatus is not in use, that is when the two U-shaped frames 14 and 16 are pressed together. By further reference to FIG. 4, it can be observed that a pulley 80 is operatively connected to the oxygen cut-off valve 70 through a shaft 82. The shaft 82 is internally connected to the cut-off valve 70 in such a manner that it will open and close the valve 70 upon rotation of the pulley 80. A cable 84 is trained around the pulley 80 and is connected to the frame section 14.

Thus, the donning of the hood over the head of the user performs two major functions when the two frames 14 and 16 are spread apart to the open condition. First of all, the oxygen is automatically turned on into the breathing plenum 58 through the regulator 68. This action results through the rotation of the pulley 80, opening the valve 70, inasmuch as the pulley 80 is operatively connected to the frame section 14 through the cable 84. In addition, the communications system including the microphone sets 46 and 48 is automatically energized. It can be observed by reference to FIG. 4, that since the communications system is provided with the on/off limit switch or microswitch 50, when the two frame sections 14 and 16 are pressed together, the contact element of the switch 50 is pushed inwardly, thereby de-energizing the microswitch 50. In a like manner, when the two frame sections 14 and 16 are opened, the microswitch 50 permits energization to the microphone sets 46 and 48.

It should be noted that the oxygen system is irreversibly turned-on when the two U-shaped frame sections 14 and 16 are spread apart to the open position. However, anyone familiar with the operation of the apparatus A could insert their hand into the hood through the neck opening and turn the valve 70 manually to the "off" position. A further cable 90 spans the two frame sections 14 and 16 and serves as a restraint to protect the fabric of the of the hood from tearing due to excessive opening of the two frame sections 14 and 16.

FIGS. 6 and 7 more fully illustrate the details of construction of the means for connecting the frame sections 14 and 16 together and the details of the manifold 108. In this case, it can be observed that the two frame sections 14 and 16 are connected by means of the spring 22 and is connected to the upper ends of the U-shaped tubes forming the two frame sections 14 and 16 by means of coil sections 28. As indicated above, the manifold 108 is designed to provide oxygen to the plenum 58. Moreover, the manifold 108 is also constructed to serve as an oxygen flow economizer as hereinafter described in more detail. As also indicated above, a continuous flow of oxygen is regulated by means of the continuous flow oxygen regulator 68 and which is normally regulated to provide a sufficient flow of oxygen for a full-grown man under exertion. This oxygen flow is therefore regulated in accordance with the size of an individual.

When the apparatus is disposed upon a person smaller than a full-grown man, the U-shaped frame sections 14 and 16 are less widely spread apart in accordance with the smaller body. The oxygen flows from the U-shaped tubes 62 forming part of the frame sections 14 and 16, and into the regulator 68 and then to the manifold 108. In this case, it can be observed that the manifold 108 comprises a manifold sleeve 110 which is essentially constructed in the form of a tube having a plurality of apertures or ports 112 longitudinally spaced along the length of the manifold 108. Moreover, an outlet tube 114 extends into the manifold sleeve 110 and is tubular in order to permit the introduction of oxygen into the manifold 108 for ultimate distribution of oxygen through the apertures 112 and into the breathing plenum 58 formed by the hood. A lug 115 is braized or welded to the tube 114 and is pivotal attached to an extended lower end of the spring 22 for retaining the tube 114, in the manner as illustrated in FIG. 7.

When the two frame sections 14 and 16 are fully spread apart, the tube 114 is retracted from the manifold sleeve 110 to its fully extended position, although it never does fully extend out of the mainfold sleeve 110. However, when the frame sections 14 and 16 are not spread apart to the fully open extent, it can be observed that the tube 114 is not fully retracted and, therefore, some of the apertures 112 are blocked by the tube 114 itself. In this way, it can be observed that the number of apertures or ports 112 which are open is proportional to the degree of opening of the two frame sections 14 and 16, and is therefore proportional to the size of the wearer's body.

It can be observed that when the frame sections 14 and 16 are shifted from the fully closed position, the oxygen has again been irreversibly turned on. Even where the frame section 14 and 16 are shifted toward the closed position, so as to carry a baby, the oxygen will still enter the plenum. However, only one of the uppermost ports 112 is opened, thereby restricting the oxygen flow to a minimum level. In this way, a longer oxygen flow time is thus aforded to smaller persons tending to meet their needs of slowness for escape from deleterious environments.

The oxygen supply tube 114 is connected directly to the flow regulator 68 through a flexible connection to the supply tube 73, and may actually be an extension of the tube 73, as described herein. However, a bypass tube 116 (FIGS. 2, 3, 6, 7) is also connected to this supply tube 114 and may be connected to the chemical gas filter through a flexible conduit 118, in a manner hereinafter described in more detail. An in-flow or so-called "in-breathing" valve 119, more fully illustrated in FIGS. 22 and 23 and described in detail hereinafter, is interposed in the line 118 for reasons which will presently more fully appear. In this way, when there is any oxygen flowing to the manifold 108, the low pressure of oxygen closes the valve in the chemical gas filter, as further described hereinafter.

The upper end on one side of the breast frame section 16 may be centrally apertured and threaded in order to receive an oxygen pressure gauge 120, as illustrated in FIGS. 3 and 7, and which may be located so that it is visible through the transparent window 38 in the hood, when the hood is folded for storage. In this case, the oxygen gauge 120 could be read in order to determine the remaining oxygen supply contained within the frame sections 14 and 16.

A bracket 122 is secured to the upper end or bight section of the spring 22 and the upper end of the manifold sleeve 110 is pivotally connected to the bracket 122 through a pivot pin 123. In addition, the bracket 122 is integrally provided with a plurality of spaced apart fingers 124 which clamp onto the upper end of the spring 22 and serve as a type of pivot restraint mechanism, as illustrated in FIGS. 6 and 7 of the drawings.

FIGS. 8–12 more fully illustrate the details of construction of the oxygen shut-off valve 70 and its relationship to one of the tubes 62 forming part of one of the frame sections 16. The shut-off valve 70 includes a valve body 128 which is apertured to provide a valve chamber 130 and in which the tube 62 extends through. In this case, the valve body 128 could be braised or welded to the tube 62. The shaft 82 is provided on its inner end with a spindle 132 which bears against a valve seat 134. In this case, the valve comprised of its spindle 132 and valve seat 134 is shown in shut-off condition. An O-ring 136 seals the threads of the spindle with respect to the valve seat 134. A one-half revolution of the spindle is sufficient to open the valve to the full flow condition.

A spring-loaded ball charging valve 138 forms part of the shut-off valve 70 and comprises a shiftable valve charging ball 139 with compression spring 140 retained by a blank plug 141. The spring 140 biases the ball 139 against the end of a duct forming an inlet port 142. Another plug 143 serves to block the inlet port 142 and which plug 143 may be removed for recharging the apparatus with oxygen. Oxygen enteres the cut-off valve 70 through the oxygen delivery tube 75 and introduces oxygen to the charging valve 138. When the charging valve 138 is in the normal operating position, the spring 140 urges the charging ball 139 to a position where oxygen flow through the charging valve 138 is not impeded. Thus, the oxygen will pass through an internal duct 144 and through an annulus 145 around the inner end of the spindle 132 which communicates with the valve seat 134. Moreover, when the pulley 80 is rotated, it will rotate the shaft 82 and hence the spindle 132 which will open the valve seat 134. In this way, oxygen will be permitted to flow through a duct 146 communicating with the valve seat 134 and through a regulator supply tube 147, the latter of which communicates with the tube 72.

The tube 62 also communicates on the front section with the tube 72 by means of an internal part 148 with an opening 149 formed in the wall of the tube 62. In this way oxygen can also be delivered directly to the part 148 and to the tube 72 when the cut-off valve 70 is opened.

The pulley 80 which is operated by the cable 84 fits on a hexagonal section of the shaft 82, and is also broached with a 12-sided hole 152. By orienting the broached hole 152 at 15° to a cable anchor hole 153 formed in the side wall of the pulley 80, it is thereby possible to have 24 positions of the anchor hole relative to the spindle to shaft 82. In this way, it is possible to permit a minimum slack in the cable 84 when the valve 70 is closed and the frame sections 14 and 16 are shifted to the folded condition.

FIGS. 20 and 21 more fully illustrate the construction employed in connection with the chemical gas filter 44 used in the apparatus of the present invention. The filter 44 comprises a housing canister 160 which is fitted into the recess 45 and may be threadedly or otherwise secured with the recess 45 at the leg section 34 of the hood. Thus, the filter 44 will be located at the vicinity of the chest of the user of the apparatus A. Nevertheless, the actual location is not important from an operational point of view. A chamber forming member 161 is located in the recess 45 and is provided with an angular flange 162 which is also glued or otherwise adhesively secured to a flange 162' on a cup-like section 163 in the fabric forming part of the front section 34 of the hood 12. The chamber forming member 161 and the cup-like section 163 form a gas receiving plenum chamber 164. This plenum chamber 164 is also in communication with the chemical filter 44 through an aperture 164 formed at the cup-like section 163. In addition, the chamber 164 is connected to the in-flow valve 119, as illustrated in FIGS. 22 and 23 of the drawings, by means of a stub pipe 168.

The in-flow valve 119 comprises an outer housing 170 with a low-weight and low-stiffness rubber bellows 172 disposed within the housing 170 and forming an interior chamber 174, as well as an exterior chamber 176. The flexible conduit 118 is connected to the housing 170 through a stub pipe 173 and leads into the interior chamber 174. A pipe 177 is braized into the housing 170 and is connected to and in fluid communication with a flexible tube 178 leading to the chamber 164. A snap ring 180 retains the bellows 172 within the housing 170. In addition, vent apertures 182 are formed within the housing 170 and communicating with the exterior chamber 176 and the interior plenum 58 formed by the hood 12. The upper end of the pipe 177 and the base of the bellows form a valve seat 184, in the manner illustrated in FIG. 23 of the drawings.

The bypass 116 communicates low pressure oxygen through the flexible pipe 118 to the interior chamber 174 of the bellows 172. This pressure is slightly higher than that in the plenum 52 of the hood 12 by the amount of the pressure drop through the manifold apertures 112. The lower pressure of the plenum 58 of the hood 12 is communicated to the outside of the bellows 172 via the ports 182 in the valve housing 170. The pressure difference between the internal chamber 174 and the external chamber 176 causes the bellows to expand and bear against the valve seat 184. Thus, so long as the oxygen supply lasts the chemical filter 44 is inoperative.

When the oxygen supply is depleted the bellows 172 are no longer pressurized. The natural resilience of the bellows 172 causes them to bear lightly against the valve seat 184. As the wearer breathes in, the outflow valves 42 close and the decreased pressure in the plenum 58 of the hood 12 causes the bellows 172 to lift off the valve seat 184 and admit filtered air from the chemical filter 44.

FIGS. 13–17 illustrate a modified form of oxygen economizer which is similar in construction and operation to the manifold 108 which serves as an economizer economizer as previously stated. In this case, the alternative form of economizer is designated by reference numeral 188.

The economizer 188 generally comprises a hollow manifold tube 190 which is similar to the manifold sleeve 110. In addition, the manifold 190 is provided with oxygen outlet apertures 192 corresponding to the oxygen outlet apertures 112 in the manifold sleeve 110. At its upper end, the manifold 190 is pivotally connected to a bracket 194, which is similar to the bracket 122. The lower end of the manifold 190 slides over a upper end of the tube 198, which is similar to the tube 114. Similarly, a clamp 197 is braized or welded to the tube 198 and forms a pivotal connection with a terminal end 199 of a spring similar to the spring 22.

As indicated previously, the economizer of the present invention is designed to modulate the supply of oxygen according to the size of the wearer's body. The economizer 188 can also be constructed in order to accomplish this purpose in a similar manner, and in this case, a weighted sleeve 200 may shiftably extend over the various apertures 192. In the case of the economizer 188, the apertures or ports 192 are smaller than the ports 112 used on the previous economizer, and are made, however, large enough for immobile persons needing less oxygen over any period of time.

The manifold 190 is provided with a further set of oxygen outlet apertures or ports 202 in the form of two slots extending down to the lower end of the manifold 190 which are normally covered by the cylindrical sleeve 200 which serves as a sliding weight. Also, in alignment with the ports 202 in the manifold 190 are two slotted ports 203 in the upper end of the tube 198. The sleeve 200 is also provided with a pair of slots 204 on its upper end and which are capable of being aligned with the apertures 192. The weight 200 is constrained in its position relative to the apertures 202 by means of a pair of low-stiffness compression springs 206 and 208 in the manner as illustrated in FIG. 14 of the drawings. Thus, the weight is essentially constrained in its sliding movement relative to the manifold 190 when the user of the apparatus does not exert any active motion so that the sliding weight 200 will normally cover the apertures 202.

When the user of the apparatus exerts himself or herself by active motion, the initial forces on the sliding weight 200 will cause it to shift upwardly or downwardly, that is to bob up and down along the economizer manifold 190, and thereby intermittently expose the apertures 202 permitting escapement of oxygen into the breathing plenum 58. In other words, active body movement will cause the sliding weight 200 to shift up and down along the manifold 190 and which active body movement causes or may cause a need for greater oxygen when the apertures 202 are exposed. In this way, the oxygen supply is increased proportionally both to the activity level of the wearer through the oxygen outlet ports 202 and in proportion to the size of the wearer through the oxygen outlet ports 192.

The sliding weight 200 is provided with the slots 204 which are located with respect to the apertures 192 so that the weight 200 will never prevent the exit of oxygen through the apertures 192. In this case, it can be observed that the apertures 192 are aligned and located in a different plane than the apertures 202 and 203. Moreover, the sliding weight 200 has a pair of keys 212 which shift in the apertured slots 202 of the manifold 190 in order to prevent rotation of the sliding weight 200. A second sleeve 215 extends around the sleeve 200 and the entire mechanism is enclosed in a housing 216.

FIGS. 1, 18 and 19, as well as FIGS. 20 and 21, illustrate the use of the apparatus A as a flotation device which incorporates a snorkel arrangement. It is well established that airliners which are routed across oceans and other large bodies of water must by law carry the so-called "life-preservers" so that escaping passengers may float in the ocean or the sea in the event of an aircraft ditching. In almost all cases, these aircraft ditchings occur a relatively long time after the initial emergency arises. In this case, the passengers in the aircraft would have an ample amount of time to don an emergency breathing apparatus of the form illustrated in FIGS. 18–19 of the drawings.

This modified form of emergency breathing apparatus is actually the apparatus A which includes the snorkel arrangement. However, for other uses, it can be observed that the apparatus A would not necessarily include the snorkel arrangement. In this embodiment, the apparatus A also includes the frame as well as the hood 12. Moreover, flotation bags 218 are mounted on the hood 12 and may be connected to each other through pipes 219.

In the event of an aircraft ditching emergency, the hood would be doned prior to touchdown in the water. A strap 226 forming part of the harness 35 would be tightened around the waist in the same manner as a life belt is attached to the individual. This strap 226 and the harness 35 are designed to prevent the wearer from slipping out of the hood when dropping into the water. The hood would operate, as previously described, in protecting against any post touchdown fire and/or smoke. In this case, the hood 12 would be provided with flotation cells 218, in the manner as previously described and as illustrated in the drawings. As indicated previously, the passengers in an aircraft have sufficient time to don the apparatus as an oxygen supply during descent. After ditching of the aircraft, the hood would serve as an emergency breathing apparatus while getting out of the aircraft and as a crash helmet during the sudden deceleration as the aircraft impacts on the water. The hood in this case makes an excellent flotation device when operated in the oxygen mode because it is slightly pressurized. But, when the oxygen is depleted and it is operating in the gas mask mode it would collapse and lose its buoyancy. Thus, the hood provides the flotation cells 218 similar to a life preserver and is inflated from a small bottle of compressed carbon dioxide 229.

FIGS. 20 and 21 illustrate a snorkel adaptation to the chemical gas filter 44, although in this case the gas filter 44 may be mounted over the shoulder portion of the individual utilizing the apparatus, if desired. A snorkel 230 is connected to the channel ring 234 and this snorkel 230 is illustrated in the stowed position in FIG. 1 of the drawings and in the erected position as illustrated in FIGS. 18, 19, 20 and 21 of the drawings.

An internal plenum chamber 232 is formed by the channel ring 234 mounted on the exterior surface of the hood 12 which is located in the area of the gas filter 44 and which includes an annular flange 235 bearing against a cover plate 236 and houses the cannister 160. An air flow passes from this plenum chamber 232 through a chemical filter 238 in the cannister 160 to the internal plenum chamber 164 through the port 165. Connected to channel ring 234 is an external rigid metal pipe elbow 244 which carries a flexible plastic snorkel pipe 246. By reference to FIG. 20 of the drawings, it can be observed that the snorkel pipe 246 is partially enclosed by an erection coil spring 248. In the released condition, the erection coil spring 248 holds the flexible pipe 246 into the vertical erected position as illustrated in FIGS. 18 and 19 of the drawings. The snorkel tube 246 is formed of a plastic material bent into an inserted U-shape and in its stowed position lies alongside of the U-shaped tube forming part of one of the frame sections 14 or 16.

The inlet end of the snorkel tube 246 contains a floating ball valve 250 as more fully illustrated in FIG. 20 of the drawings and whcih comprises an outer cage 252 having an inlet port 253. The ball valve 250 also includes a ball valve member 254 at an inlet end 251 of the tube 246, and where ball valve member 254 is capable of bearing against O-ring valve seat 258. In this case, if the air inlet of the cage 252 is temporarily submerged, the ball valve element 254 normally floats upwardly and seals off the inlet 256 by bearing against the O-ring valve seat 258. A microswitch 262 (FIG. 20) is secured to the frame forming part of this latter embodiment of the apparatus and is normally in the closed position. This microswitch 262 is connected to a conventional flashing light 264 mounted on the hood through a conventional circuit (not shown or described). In this respect, it should be observed that this latter circuit for energizing the light 264 is energized with the same dry cell battery which powers the communications system.

The apparatus of the present invention for this latter embodiment has been described in connection with its use as emergency equipment for use in aircraft. Once the individual has exited the aircraft through an emergency door, he would release the snorkel by lifting three press-stud retaining straps 270 (FIG. 18). Initiation of inflation of the flotation cells 218 from the small bottle of compressed carbon dioxide gas 229 is achieved by pulling the knob 269 which operates a pierced-diaphragm type valve on the bottle 229, as is conventionally used on inflatable life preservers. In this case, the survivor would float with his head partially above the water, at least high enough in the water to enable viewing out of the transparent window 38 forming part of this apparatus. Moreover, the individual would be visible in a dark environment by means of the flashing light 264 over the head of the hood. In addition, the head of the individual would be protected from cold inasmuch as the head of the individual is a dissipater of body heat and this added protection considerably increases the duration of survival in water. The inwardly facing speaker-microphone, corresponding to the speaker-microphone 46, is in the same location as previously described, that is, close to the wearer's mouth. The outwardly facing speaker-microphone, corresponding to the speaker-microphone 48, is located above the shoulder portion of the individual so that it is not submerged.

It can be observed that the breathing apparatus of the present invention is useful in a high number of environments and serves a large number of functions. The emergency breathing apparatus A of the present invention can be utilized in such a manner that external oxygen supply is not required. Furthermore, it can be observed that this device can function as a flotation device, and even furthermore, can function as a device which is capable of being used in aircraft for preserving the life an an individual in a body of water.

Thus, there has been illustrated and described a novel emergency breathing apparatus which fulfills all of the objects and advantages sought therefor. Many changes, modifications, variations, and other uses and applications of this emergency breathing apparatus and the varied components therein, will become apparent to those skilled in the art after considering the specification and the accompanying drawings. All such changes, modifications, variations, and other uses and applications which do not depart from the spirit and scope of the invention are deemed to be covered by the invention which is limited only by the following claims.

Having thus described the invention, what I desire to claim and secure by letters patent is:

1. An emergency breathing apparatus for donning by an individual to create a substantially air-tight breathing plenum for the individual; said apparatus comprising:

(a) frame means comprising a relatively rigid frame section, (b) said frame section having a chamber means formed therein capable of containing a supply of an oxygen containing gas, (c) a hood formed of a relatively flexible substantially air-impervious material operatively located over a portion of said frame means and sized to be disposed over the head of an adult individual to form a breathing plenum, (d) gas dispensing means comprising an outlet means on said frame section to permit the dispensing of said gas from said chamber means to said plenum when said apparatus is donned by an individual, and (e) switch means automatically responsive to the donning of said apparatus for automatically dispensing the gas from the chamber to the plenum.

2. The emergency breathing apparatus of claim 1 further characterized in that said frame section is constructed of a plurality of hollow pipe sections which form an internal chamber and which are connected together to form said chamber means.

3. The emergency breathing apparatus of claim 1 further characterized in that said hood is provided with a transparent member on a front portion thereof in the vicinity of the eyes of a user for visual ability by the user of said apparatus, and a heat resistant protective member disposed over said transparent member to protect same.

4. The emergency breathing apparatus of claim 1 further characterized in that said hood is provided with a two-way audio means to enable the user of the apparatus to speak to and hear another individual.

5. The emergency breathing apparatus of claim 1 further characterized in that said hood is provided with filtering means to permit passage of breathable air without passage of toxic gas harmful to a human being, and which filtering means is capable of taking in a breathable air from the external atmosphere and filtering such toxic gas therefrom in response to the exhaustion of said supply of oxygen containing gas in said chamber means.

6. The emergency breathing apparatus of claim 1 further characterized in that said hood is provided with a hard impact resistant crown and an overlaying compliant cushion to protect the head of the user from knocks and bruises.

7. The emergency breathing apparatus of claim 6 further characterized in that said impact resistant crown is comprised of a multiplicity of individual plates to facilitate stowage.

8. An emergency breathing apparatus for donning by an individual to create a substantially air-tight breathing plenum for the individual; said apparatus comprising:

(a) frame means comprising a relatively rigid frame section, (b) said frame section being comprised of a plurality of hollow pipe sections which are connected together to form a chamber means therein capable of containing a supply of an oxygen containing gas, (c) a hood formed of a relatively flexible substantially air-impervious material operatively located over at least a portion of said frame means and sized to be disposed over the head of an adult individual to form a breathing plenum, (d) outlet means in said pipe sections permitting the dispensing of said gas from said chamber to said plenum, (e) switch means automatically responsive to the donning of said apparatus for automatically dispensing the gas from the chamber to the plenum, (f) a transparent member in a front portion of said hood in the vicinity of the eyes of a user of said apparatus for visual ability by the user of said apparatus, (g) a heat resistant protective member disposed over said transparent member to protect same, (h) a two-way audio means in said hood to enable the user of the apparatus to speak to and hear another individual, (i) and filtering means in said hood to permit passage of breathable air without passage of toxic gas harmful to a human being, and which filtering means permits passage of the breathable air with filtering of toxic gas in response to the exhaustion of said supply of oxygen containing gas in said chamber means.

9. An emergency breathing apparatus comprising:

(a) a first frame member having a chamber therein for storing an oxygen containing gas under pressure, (b) a second frame member having a chamber therein for storing a similar oxygen containing gas, (c) hinge means operatively connecting said first and second frame members at one of the ends thereof so that the other of the ends of said frame members can be shifted from a closed position to an open position, (d) a hood formed of a relatively flexible substantially air-impervious material operatively connected to and disposed over said first and second frame members, (e) means on said hood to enclose said hood at least about the head portion of an individual using said apparatus to provide a substantially air-tight plenum, (f) and gas dispelling means to release said gas in said chambers to said plenum.

10. The emergency breathing apparatus of claim 9 further characterized in that said first and second frame members have upper ends are hingedly connected together in proximity to their upper ends; and spring means is operatively associated with said frame sections to bias said frame sections together.

11. The emergency breathing apparatus of claim 9 further characterized in that said first and second frame members are somewhat U-shaped in construction and each are formed of hollow tubular members having internal chambers for storing said gas under pressure.

12. The emergency breathing apparatus of claim 9 further characterized in that said apparatus comprises a gas regulator, said gas dispelling means comprises apertured means in said first and second frame members to release said gas to said plenum, and actuating means is connected between said regulator and said apertured means in said frame members to release said gas from said chambers to said regulator and hence to said plenum when said first and second frame members are shifted to the open position such that the gas is released to said plenum in an amount controlled by said gas regulator.

13. The emergency breathing apparatus of claim 9 further characterized in that flow adjustment means is operatively associated with said gas dispelling means to automatically adjust the amount of gas released to the plenum as a function of the size of an individual using said apparatus.

14. The emergency breathing apparatus of claim 9 further characterized in that economizer flow means is operatively associated with said gas dispelling means to automatically adjust the amount of gas released to the plenum in response to the plenum as a function of the physical exertion level exercised by the individual using said apparatus.

15. A self-contained emergency breathing apparatus comprising:

(a) frame means comprised of at least one tubular member, (b) a hood operatively located on said frame means to extend over the head of a user of the apparatus to create a plenum chamber around the head of the user, (c) said tubular member having a chamber therein forming an oxygen supply means operatively located with and carried by said frame means to render said apparatus a self-contained unit, (d) and release means operatively connected to said supply means and automatically responsive to the donning of said apparatus to automatically release oxygen containing gas from said supply means to said plenum chamber upon donning by the user.

16. The apparatus of claim 15 further characterized in that flow adjustment means is operatively associated with said release means to automatically adjust the amount of oxygen released to the plenum chamber as a function of the size of an individual using said apparatus.

17. A self-contained emergency breathing apparatus comprising:

(a) frame means, (b) a hood operatively located on said frame means to extend over the head of a user of the apparatus to create a plenum chamber around the head of the user, (c) oxygen supply means carried by said frame means for supplying oxygen to the interior of said hood, (d) a snorkel tube operatively associated with said apparatus and having a portion in fluid communication with said plenum chamber and means for holding said snorkel tube in a nested position about said hood whereby, said snorkel tube can be extended to an open position where an outer end of said snorkel tube extends beyond said hood to be in communication with an external air containing atmosphere, (e) and means operatively associated with said snorkel tube to permit air from the external atmosphere to enter the plenum chamber when in the open extended position.

18. The self-contained emergency breathing apparatus of claim 17 further characterized in that said apparatus is adapted to be used on aircraft for survival in a water media.

19. The self-contained emergency breathing apparatus of claim 17 further characterized in that said oxygen supply means is operatively located with and carried by said frame means to render said apparatus a self-contained unit.

20. The self-contained emergency breathing apparatus of claim 17 further characterized in that said frame means is comprised of at least one tubular member having a chamber therein which constitutes said oxygen supply means.

21. An oxygen supply system for supplying oxygen to a plenum chamber created by a hood surrounding the head of an individual, said system comprising:

(a) a frame member, (b) an oxygen reservoir contained in said frame means, (c) a hood carried by said frame means and being disposed over a portion of said frame means and creating a plenum chamber surrounding the head of an individual, (d) valve means responsive to the donning of said frame member carrying said hood to automatically open and permit a supply of oxygen from said oxygen reservoir to said plenum chamber, (e) regulator means connected to said valve means to control the flow of oxygen to said plenum chamber, and (f) flow adjustment means operatively connected to said regulator means to automatically adjust the amount of oxygen released to the plenum chamber as a function of the size of an individual using said apparatus.

22. The oxygen supply system of claim 21 further characterized in that economizer flow means is operatively connected to said flow adjustment means to automatically adjust the amount of oxygen released to the plenum chamber as a function of the physical exertion level exercised by an individual using said apparatus.

23. A method of supplying oxygen to a plenum chamber surrounding the head of an individual in an emergency situation, and which plenum chamber is created by a hood supported by first and second frame sections capable of being expanded from a folded position and having chambers therein constituting a supply of oxygen, said method comprising:

(a) expanding said first and second frame sections from a folded position to an open position,
(b) automatically releasing the supply of oxygen from said chambers to said plenum chamber as said frame sections are expanded, and
(c) automatically regulating the supply of oxygen to said plenum chamber upon opening said frame sections and as a function of the size of an individual.

24. An emergency breathing apparatus for donning by an individual to create a substantially air-tight breathing plenum for the individual; said apparatus comprising:
(a) frame means comprising a relatively rigid frame section,
(b) said frame section being comprised of a plurality of hollow pipe sections operatively connected together with each having an internal chamber therein forming a chamber means capable of containing a supply of an oxygen containing gas,
(c) a hood formed of a relatively flexible substantially air-impervious material disposed over a portion of said frame section with said hood and sized to be disposed over the head of an adult individual to form a breathing plenum,
(d) and gas dispensing means operatively associated with said chamber means and responsive to the donning of said apparatus to automatically permit the dispensing of said gas from said chamber means to said plenum when said apparatus is donned by an individual.

25. The emergency breathing apparatus of claim 24 further characterized in that said gas dispensing means comprises outlet means in said frame section permitting the dispensing of said gas from said chamber, and switch means automatically responsive to the donning of said apparatus to automatically dispense the gas from the chamber to the plenum.

26. The emergency breathing apparatus of claim 24 further characterized in that said hood is provided with a transparent member on a front portion thereof in the vicinity of the eyes of a user for visual ability by the user of said apparatus, and a heat resistant protective member disposed over said transparent member to protect same.

27. The emergency breathing apparatus of claim 24 further characterized in that siad hood is provided with a two-way audio means to enable the user of the apparatus to speak to and hear another individual.

28. The emergency breathing apparatus of claim 24 further characterized in that said hood is provided with filtering means to permit passage of breathable air without passage of toxic gas harmful to a human being, and which filtering means is capable of passage of breathable air from the external atmosphere and filter such toxic gasses therefrom in response to the exhaustion of said supply of oxygen containing gas in said chamber means.

29. A self-contained emergency breathing apparatus comprising:
(a) frame means,
(b) a hood operatively located on said frame means to extend over the head of a user of the apparatus to create a plenum chamber around the head of the user,
(c) oxygen supply means operatively located with and carried by said frame means to render said apparatus a self-contained unit,
(d) release means operatively connected to said supply means and responsive to the donning of said apparatus to automatically release an oxygen containing gas from said supply means to said plenum chamber upon donning by the user, and
(e) flow adjustment means operatively associated with said release means to automatically adjust the amount of oxygen released to the plenum chamber as a function of the size of an individual using said apparatus.

30. The apparatus of claim 29 further characterized in that said frame means is comprised of at least one tubular member having a chamber therein which constitutes said oxygen supply means.

31. A self-contained emergency breathing apparatus comprising:
(a) frame means,
(b) a hood operatively located on said frame means to extend over the head of a user of the apparatus to create a plenum chamber around the head of the user,
(c) oxygen supply means operatively located with and carried by said frame means to render said apparatus a self-contained unit,
(d) release means operatively connected to said supply means and responsive to the donning of said apparatus to automatically release an oxygen containing gas from said supply means to said plenum chamber upon donning by the user, and
(e) economizer flow means operatively associated with said release means to automatically adjust the amount of oxygen released to the plenum chamber as a function of the physical exertion level exercised by an individual using said apparatus.

32. A self-contained emergency breathing apparatus comprising:
(a) frame means capable of being expanded from a folded condition,
(b) a hood operatively located on said frame means to extend over the head of a user of the apparatus to create a plenum chamber around the head of the user,
(c) oxygen supply means operatively located with and carried by said frame means to render said apparatus a with self-contained unit,
(d) release means automatically operable upon opening of said frame means from a folded condition and which is operatively connected to said supply means to automatically release an oxygen containing gas from said supply means to said plenum chamber upon donning by the user, and
(e) an oxygen regulator operatively connected to said supply means and interposed between said supply means and said plenum chamber to regulate the supply of oxygen from said supply means to said plenum chamber.

33. A self-contained emergency breathing apparatus comprising:
(a) frame means capable of being expanded from a folded condition
(b) a hood operatively located on said frame means to extend over the head of a user of the apparatus to create a plenum chamber around the head of the user,
(c) oxygen supply means operatively located with and carried by said frame means to render said apparatus a self-contained unit, (d) release means automatically operable upon opening of said frame means from a folded condition and which is operatively connected to said supply means to automatically release an oxygen containing gas from said supply means to said plenum chamber upon donning by the user; and (e) an economizer flow means operatively associated with said release means to automatically adjust the amount of oxygen released to the plenum chamber as a function of the physical exertion level exercised by an individual using said apparatus.

34. A self-contained emergency breathing apparatus comprising:

(a) frame means, (b) a hood operatively located on said frame means to extend over the head of a user of the apparatus to create a plenum chamber around the head of the user, (c) oxygen supply means operatively located with and carried by said frame means to render said apparatus a self-contained unit, (d) release means operatively connected to said supply means and responsive to the donning of said apparatus to automatically release an oxygen containing gas from said supply means to said plenum chamber upon donning by the user, and (e) a gas filter means located on said hood to permit entry of filtered air from the external atmosphere in response to the exhaustion of the oxygen supply in said oxygen supply means.

35. An oxygen supply system for supplying oxygen to a plenum chamber created by a hood surrounding the head of an individual, said system comprising:

(a) a frame means, (b) an oxygen reservoir contained in said frame means, (c) a hood carried by said frame means and creating a plenum chamber surrounding the head of an individual, (d) valve means responsive to the donning of said frame means carrying said frame means carrying said hood to automatically open and permit a supply of oxygen to said plenum chamber, (e) regulator means operatively connected to said valve means to control the flow of oxygen to said plenum chamber, and (f) economizer flow means operatively connected to said regulator means to automatically adjust the amount of oxygen released to the plenum chamber as a function of the physical exertion level exercised by an individual using said apparatus.

36. The oxygen supply system of claim 35 further characterized in that flow adjustment means is operatively associated with said regulator means to automatically adjust the amount of oxygen released to the plenum chamber as a function of the size of an individual using said apparatus.

37. A method of supplying oxygen to a plenum chamber surrounding the head of an individual in an emergency situation, and which plenum chamber is created by a hood supported by first and second frame sections capable of being expanded from a folded position and having chambers therein constituting a supply of oxygen, said method comprising:

(a) expanding said first and second frame sections from a folded position to an open position, (b) automatically releasing the supply of oxygen from said chamber to said plenum chamber as said frame sections are expanded, and (c) automatically regulating the supply of oxygen to said plenum chamber upon opening said frame sections and as a function of the physical exertion level of an individual.

38. The method of claim 37 further characterized in that said method comprises automatically regulating the amount of oxygen supplied as a function of the size of an individual.

39. A self-contained emergency breathing apparatus comprising:

(a) frame means, (b) a hood operatively located on said frame means to extend over the head of a user of the apparatus to create a plenum chamber around the head of the user, (c) a self-contained stored oxygen supply means operatively located with and carried by said frame means to render said apparatus a self-contained unit, (d) release means includng a means which is actuable when the apparatus is donned by a user and which is operatively connected to said supply means to automatically release an oxygen containing gas from said supply means to said plenum chamber upon donning by the user, and (e) said frame means being comprised of at least one tubular member having a chamber therein which constitutes said oxygen supply means.

* * * * *